US007296660B1

(12) United States Patent
Bauge

(10) Patent No.: US 7,296,660 B1
(45) Date of Patent: Nov. 20, 2007

(54) RESIDENTIAL ELEVATOR

(75) Inventor: Harry G. Bauge, 1208 Gardengrove Ct., Plano, TX (US) 75075

(73) Assignee: Harry G. Bauge, Plano, TX (US)

( * ) Notice: Subject to any disclaimer, the term of this patent is extended or adjusted under 35 U.S.C. 154(b) by 0 days.

(21) Appl. No.: 11/383,790

(22) Filed: May 17, 2006

(51) Int. Cl.
*B66B 9/02* (2006.01)

(52) U.S. Cl. ..... 187/250; 187/269

(58) Field of Classification Search ..... 187/250, 187/269

See application file for complete search history.

(56) References Cited

U.S. PATENT DOCUMENTS 2,903,896 A * 9/1959 Greene ..... 74/89.21
4,026,519 A * 5/1977 Piercy ..... 254/2 R
4,084,660 A 4/1978 Anderson
4,360,187 A * 11/1982 Chapman ..... 254/8 R
4,658,934 A 4/1987 Cooper et al.
4,664,230 A 5/1987 Olsen
4,953,262 A * 9/1990 Zinser ..... 414/639
5,090,515 A 2/1992 Takahashi et al.
5,111,912 A * 5/1992 Kempf ..... 187/250
5,152,374 A 10/1992 Pokus
5,572,930 A 11/1996 Hein
5,845,745 A 12/1998 Lane
5,855,253 A 1/1999 Bourgeois
6,547,217 B1 * 4/2003 Dygert ..... 254/8 R

FOREIGN PATENT DOCUMENTS

EP 0 406 927 A2 * 6/1990

OTHER PUBLICATIONS

U.S. patent application entitled "Operating Residential Elevator," by Harry Bauge, filed May 17, 2006, as U.S. Appl. No. 11/383,788.

* cited by examiner

*Primary Examiner*—Thomas J. Brahan
(74) *Attorney, Agent, or Firm*—Conley Rose, P.C.; Michael W. Piper

(57) ABSTRACT

An elevator for moving a person between two levels. The system includes at least one carriage in a hoist way extending between two floors. A lever arm lifting system moves the carriage. The lever arm may be an articulated lever arm having a primary arm having a first end rotating on a primary shaft supported on the building structure and a primary sprocket wheel fixed to the primary shaft. A secondary arm has a first end rotating on a secondary shaft carried on a second end of the primary arm. A secondary sprocket wheel is also carried on the secondary shaft and is fixed to the secondary arm. The primary and secondary sprocket wheels are coupled by a chain belt. A second end of the secondary arm is coupled to the carriage. An electric motor is coupled to the primary arm to rotate it around the primary shaft, and to thereby move the carriage between the two levels.

16 Claims, 5 Drawing Sheets

RESIDENTIAL ELEVATOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to elevators and more particularly to an elevator adapted for moving a person between two levels in a building.

BACKGROUND OF THE INVENTION

Essentially every commercial building having more than one floor is equipped with a commercial elevator system. High-rise buildings have fast cable lifted elevators that are very complicated and expensive due to the necessary controls and safety features. In low-rise buildings, hydraulic elevators are often used and are normally very slow.

Commercial units are designed to serve multiple floors by simply adding necessary electronics and mechanical components to allow the desired number of stops. These designs must be able to locate each floor and stop precisely at the same point independent of the load being carried. They must also travel relatively slowly in order to minimize the jolting sensation at start and stop. Although some designs allow for a 'soft' start (the electric motor power is ramped up and down at start and stop), the travel rate must still be relatively slow for safety reasons. The electronics required to locate each floor are costly as are the mechanical brakes necessary to hold the car on each floor.

Elevators available for personal residences are typically scaled down versions of commercial elevators. By replicating the design of smaller commercial units, residential elevators retain those units inherent inefficiency when applied to a two-stop application. They are typically expensive and slow.

A need has been recognized for a simplified elevator system for the typical two-story residence. For example, U.S. Pat. No. 5,152,374 discloses an elevator system for a two-story building having two carriages mounted in a counterbalanced arrangement and both supported and moved by a pair of chains driven by a sprocket system. This arrangement shares many of the characteristics of commercial cable and drum lifted elevators including the need for controls to stop the carriages at the two floor levels, a braking system and safety features to allow a person to release doors in event of failure of the system.

SUMMARY OF THE INVENTION

An elevator for transporting a person between two floors of a building includes at least one carriage and a lifting system including a rotating lever arm and means for converting the rotational motion of the arm to vertical lifting motion of the carriage.

In one embodiment, a primary lever arm is rotated by an electric motor, preferably with a gearbox. A first end of the primary lever arm rotates on a primary shaft fixed to the building. A first sprocket wheel is fixed to the primary lever arm and concentric with and rotates on the primary shaft. A second sprocket wheel is coupled to the motor output shaft and is coupled by a chain belt to the first sprocket wheel.

In one embodiment, the rotating lever arm is an articulated lever arm including the primary lever arm and a secondary lever arm. The primary lever arm has a secondary shaft on a second end around which a first end of the secondary lever arm rotates. A third sprocket wheel is concentric to the primary shaft and fixed to the building and is coupled by a chain belt to a fourth sprocket wheel concentric to the secondary shaft and fixed to the secondary arm. The third sprocket wheel has twice as many sprockets or cogs as the fourth sprocket wheel. A lifting coupling, preferably a shaft, is carried on a second end of the secondary lever arm and is coupled to the carriage to move the carriage vertically.

In one embodiment, the rotating lever arm comprises only the primary lever arm. The secondary shaft becomes the lifting coupling or lifting shaft. In this embodiment, the lifting coupling is coupled to the carriage by a pivot bar or a slide rail to compensate for curved motion of the lifting shaft.

In one embodiment, the elevator includes two carriages coupled together by a cable and pulley system. When one carriage is located at one floor level, the other is located at a second floor level and vice versa. The disclosed lift system directly moves one carriage and the other carriage is moved through the cable and pulley system.

A method of operating a residential elevator includes a control system and door sensors detecting the opening and closing of doors covering a hoist way, which may also be referred to as an elevator shaft, in which the carriage travels between floors. The control system detects a first opening and closing of a door in front of the carriage and activates a lift system to move the carriage to an opposite floor, e.g. from a first floor to a second floor. Upon detecting a second opening and closing of a door in front of the carriage, the control system places the lift system in a standby state. Upon detecting a third opening and closing of a door in front of the carriage, the control system again activates the lift system to move the carriage to an opposite floor, e.g. from a second floor to a first floor.

DETAILED DESCRIPTION OF THE PREFERRED EMBODIMENTS

Embodiments of elevators according to the present invention provide a means for transporting a person vertically between two levels. Generally this is referred to herein as moving a person between two floors, typically a first floor and a second floor of a building, typically a residence. In some countries this would be referred to as moving between the ground floor and the first floor, i.e. the first floor above the ground floor. However, the two levels or floors may be a basement and a ground floor, or a second and third floor or attic. The two floors do not have to be immediately adjacent, e.g. the two floors could be a first floor and a third floor or attic without a stop on an intermediate second floor.

Figure 1:
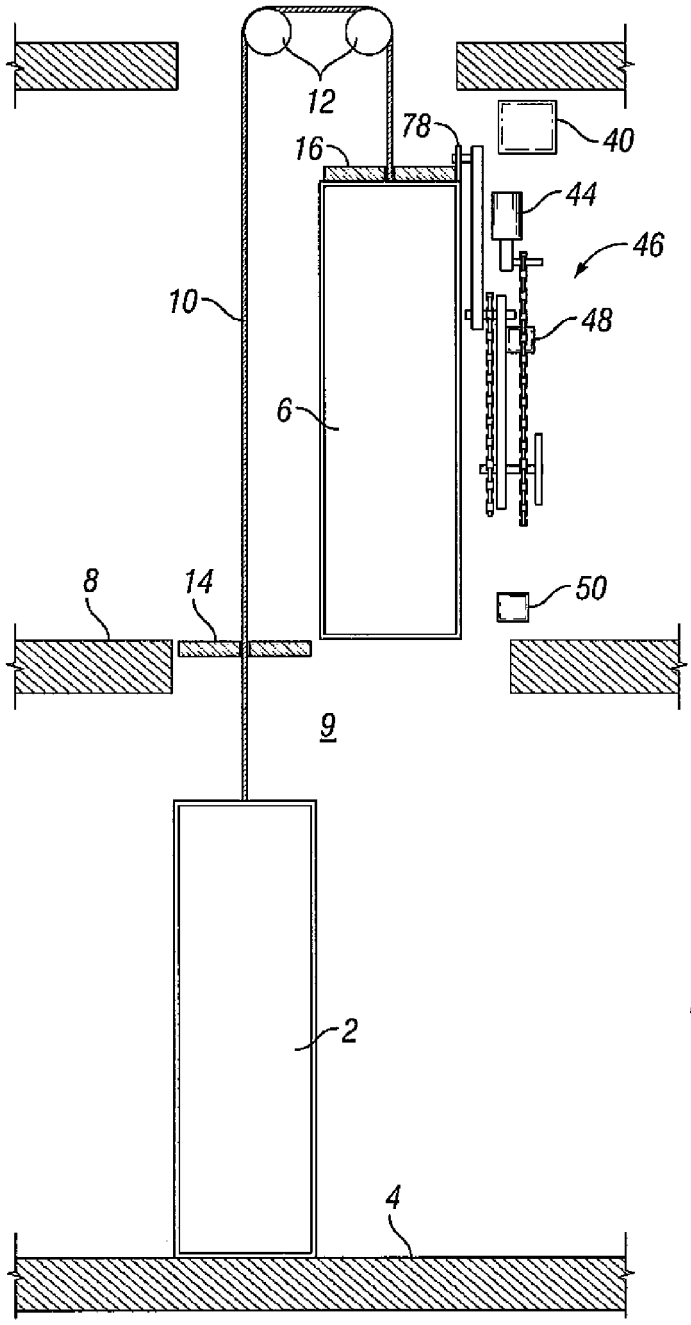
FIG. 1 is a schematic front view of an embodiment of an elevator according to the present invention.
Figure 2:
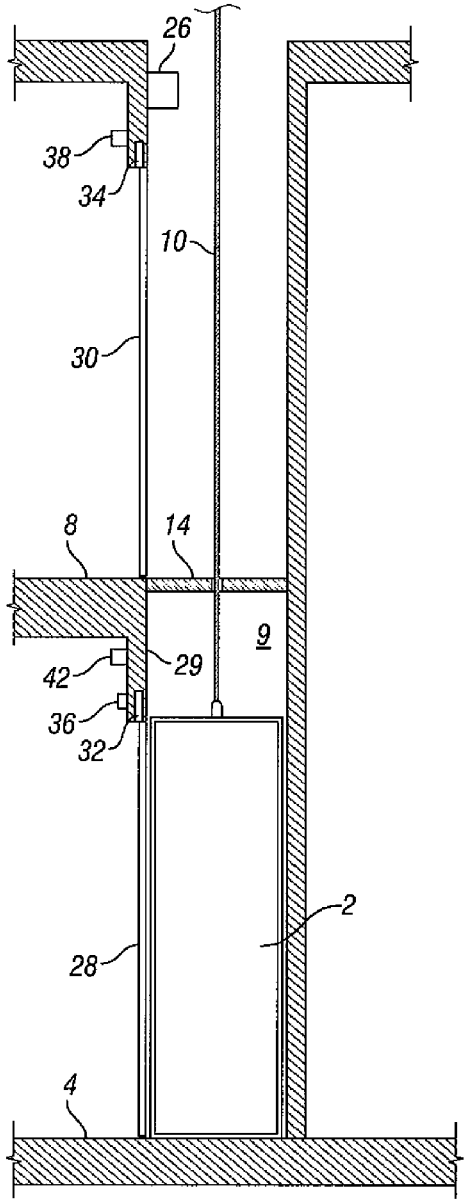
FIG. 2 is a schematic side view of an embodiment of an elevator according to the present invention.

FIGS. 1 and 2 are front and side views, respectively, of the basic components of an elevator according to one embodiment. A first carriage 2 is shown positioned at a first floor level 4 and a second carriage 6 is shown positioned at a second floor level 8. The carriages are in hoist way 9 extending from the first floor level 4 to the second floor level 8. The two carriages 2,6 are connected together by a cable or wire rope 10 that is supported by a pair of pulleys 12 at the top of the system. The two carriages 2 and 6 counterbalance each other. The carriages will always move in opposite directions so that when one is located at the first floor 4 the other will be located at the top floor 8. In other embodiments, the carriage 2 may be replaced with a simple counterweight to save space, although certain benefits of the two-carriage arrangement will be lost.

Preferably, the wire rope 10 comprises two separate wire ropes, each sufficiently strong to support the weight of a carriage 2, 6 and an occupant. The second wire rope may be slightly longer than the first and act as a safety back up in case of failure of the first. If the length of the second rope is selected properly, in event of failure of the first rope, the carriage 2 may contact the bottom of hoist way 9 each time it moves down to the first floor level 4. The resulting bump or jerk would be a signal to a user that there is a problem that requires a service call, i.e. to replace the failed wire rope. Alternatively, the wire ropes 10 may be of equal length if they are coupled to at least one of the carriages 2, 6 with a pivot so that upon failure of one rope 10 the effective length of the rope plus pivot would increase.

Figure 3:
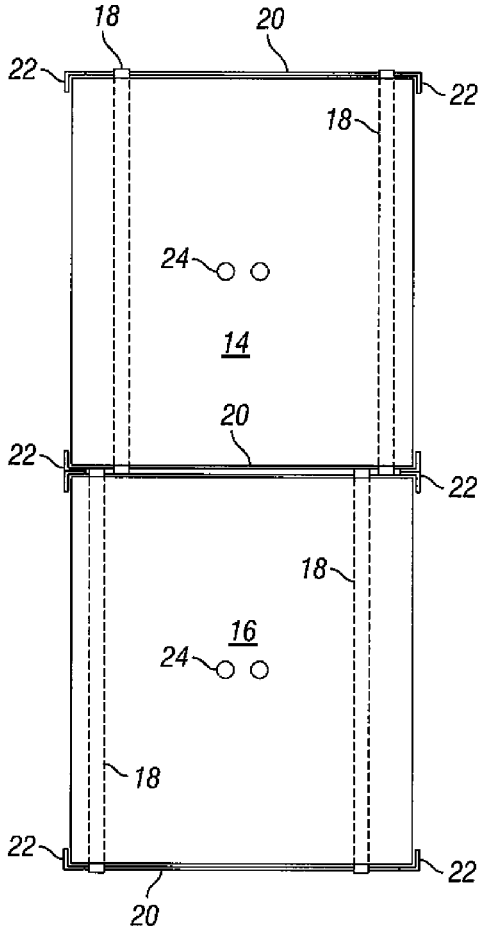
FIG. 3 is a top view of safety platforms.

With reference to FIGS. 1, 2, and 3, in one embodiment, a pair of safety platforms 14 and 16 are provided for the two carriages 2 and 6 respectively. When a carriage is located at the upper floor, the safety platform rests on top of the carriage and is carried up with it, as shown for safety platform 16 on top of carriage 6. When a carriage moves down to the first floor, the safety platform catches on the second floor 8 level as platform 14 is shown in FIGS. 1 and 2. If a person should accidentally enter the second floor space above a carriage on the first floor, the safety platform prevents the person from dropping down on top of the carriage on the first floor.

With specific reference to FIG. 3, the safety platforms 14, 16 are shown having structural ribs 18 that extend across and under the platforms and extend a short distance beyond the edges of the platforms 14, 16. The ends of the ribs 18 engage crossbars 20 located at the second floor 8 level. The cross bars 20 are connected to vertical rails 22 that guide the carriages 2, 6. The ribs 18 and cross bars 20 position the safety platforms 14, 16 at the second floor 8 level when the respective carriages 2, 6 are located at the first floor 4 level. Holes 24 are provided in the safety platforms 14, 16 to accommodate the supporting cables 10 and allow the cables to move through the platforms as the carriage moves down to the first floor 4 level.

It is preferred that the safety platforms 14, 16 be made of a transparent or translucent material such as clear or white Plexiglas or Lexan. In this embodiment, light fixtures 26 are provided at the top of each hoist way. The top of each carriage 2, 6 is either open or made of transparent or translucent material to allow light from the fixtures 26 to illuminate the interior of the carriages 2, 6. The transparent or translucent safety panels 14, 16 allow light to pass through from the fixture 26 to the carriages 2, 6. This arrangement avoids the need to provide electrical power to the carriages for lighting, which would require a moving electrical connection.

A second embodiment of the safety platforms would be platforms hinged to the side or rear of the hoist way 9 and flush with the top of the second level floor when in a lowered position. The platforms would be slotted to pass by the carriage lifting cables 10. The platforms would flip up as a carriage moves from the lower level to the upper level and down as the carriage passes and moves to the lower level.

As an alternative to the safety platforms 14,16, automatic door locks may be provided to prevent opening of doors when there is no carriage behind the doors or when the carriages 2, 6 are in motion.

The elevator system of this embodiment includes four generally conventional residential interior doors which close on and cover the hoist way 9, two on the first floor 4 and two on the second floor 8. The doors preferably have spring-loaded hinges that hold the doors in a closed position unless a user pulls or pushes the doors open. In addition, a magnetic strip may be fixed to the leading inside edge of each door that will be attracted to vertical guide rails 22 to minimize door bounce and assist in holding each door in a closed position, preferably with sufficient force to deter small children from opening the doors. No latches are needed to hold the doors closed, but may be used if desired. The doors are not shown in FIG. 1, since they would cover all of the other elements of the system. In FIG. 2 a door 28 is shown on the first floor 4 closed in front of the carriage 2, and a door 30 is shown on the second floor closed in front of the open hoist way 9 above carriage 2. The system also includes four sensors, one for each of the four doors, to detect whether the doors are closed or open. Each sensor may be a magnetically actuated switch with each door carrying a magnet to actuate the switch. In FIG. 2, a sensor 32 is shown for door 28 and sensor 34 is shown for door 30. It is preferred that the back side of each door 28 and 30 be smooth and aligned with a smooth inner wall surface 29 extending between the top of door 28 and the bottom of door 30. With this alignment and smooth surfaces, there are no edges on which a person's hand, foot, clothing, etc. could catch as the carriages 2 and 6 move between the two floors.

A light or other visual indicator is provided above each of the four doors. In FIG. 2 an indicator light 36 is shown above door 28 and an indicator light 38 is shown above door 30. In FIG. 2, the indicator light 36 would be turned on to indicate that the system is activated and that the carriage 2 is positioned behind door 28, ready for use. The light 38 would not be activated because there is no carriage in the space behind door 30. In this position, the carriage 6 is on the second floor and the light above its second floor door would be illuminated. Thus when the system is activated, one light on each floor will be on to indicate that the system is operating and to indicate which door has a carriage available behind it. While the carriages are in motion from floor to floor, all indicator lights will be off to indicate such movement and the fact that no carriage is available for use.

Other electrical controls are also illustrated in FIGS. 1 and 2 and are described in detail below. These include an electrical control panel 40 that contains many of the elements shown in FIG. 7. A reset button 42 is provided above the main floor doors to reset the system in the event one of the safety systems detects a problem and deactivates the control system. An electric motor 44 is provided for driving a lever arm lift system 46 to move the carriages 2, 6 between the floors 4, 8. An upper limit switch 48 is provided for detecting when the lever system 46 reaches an upper position and a lower limit switch 50 is provided for detecting when the lever system reaches a lower position.

Figure 4:
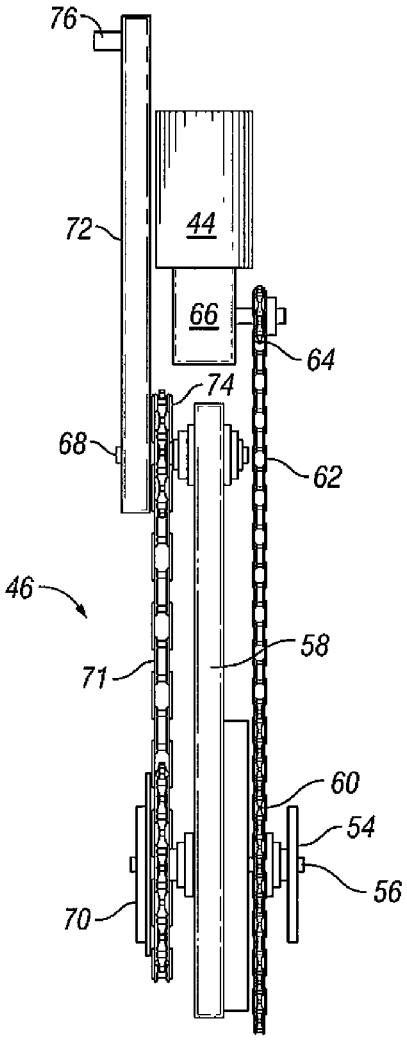
FIG. 4 is a front view of a lifting mechanism of an embodiment of the present invention.
Figure 5:
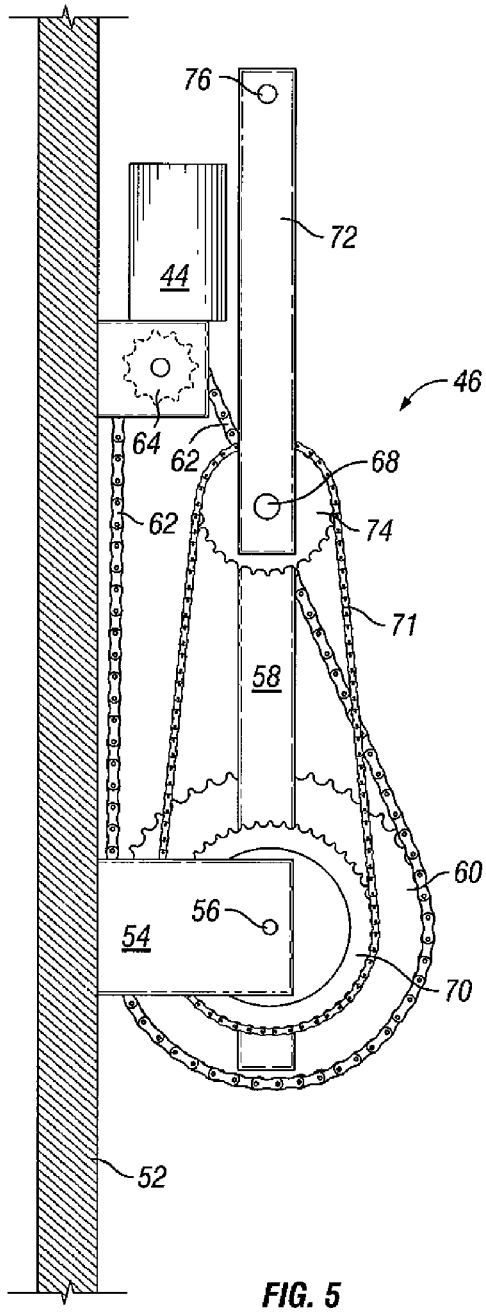
FIG. 5 is a side view of a lifting mechanism of an embodiment of the present invention.

FIGS. 4 and 5 illustrate details of the structure of an articulated lever lift system 46 used in one embodiment. This lift system converts rotary motion into linear motion to move the carriages 2, 6 vertically. The lift system 46 is supported on a wall 52 of a building, preferably by a steel frame 54 attached to the wall 52. A primary shaft 56 is fixed to the frame 54 and thereby to the building. A primary arm 58 and a first sprocket wheel 60 rotate on the shaft 56. The first sprocket wheel 60 is fixed to the arm 58 and rotates with it. A first chain belt 62 extends around the first sprocket wheel 60 and also engages a second sprocket wheel 64 connected to an output shaft of the motor 44. It is preferred to have a speed-reducing gearbox 66 between the motor 44 and the sprocket wheel 64 to slow the output speed and increase available torque. Second sprocket wheel 64 is smaller than the first sprocket 60, thereby providing rotary speed reduction and increased torque, in addition to that provided by the gear box 66.

In other embodiments, an output shaft of a drive motor and gearbox combination may be connected directly to the primary arm 58 to rotate it. The first and second sprocket wheels 60, 64 and chain belt 62 could be eliminated. However, this requires a larger, stronger, and more expensive gearbox 66. In other embodiments, the primary arm 58 can be rotated by a hydraulic cylinder, an air driven cylinder, or any other motor or machine capable of moving the primary arm, all of which are considered motive force generators for the purpose of this invention.

A secondary shaft 68 is fixed on an end of primary arm 58 opposite from the primary shaft 56. A third sprocket wheel 70, concentric with the primary shaft 56 and fixed to frame 54, does not rotate on the shaft 56 and therefore does not rotate relative to frame 54 and the building wall 52. A secondary arm 72 and a fourth sprocket wheel 74 rotate on the secondary shaft 68. The fourth sprocket wheel 74 is fixed to the arm 72 and rotates with it. A second chain belt 71 is carried on the third and fourth sprocket wheels 70, 74. A third shaft 76, also referred to as a lifting shaft, is fixed to an end of secondary arm 72 opposite the shaft 68. As shown in FIG. 1, the third shaft 76 engages a link 78 attached to the carriage 6, to move the carriage 6 between the first floor level 4 and the second floor level 8. As discussed above, movement of the carriage 6 also moves the carriage 2 by way of the cables 10 and pulleys 12.

Figure 6:
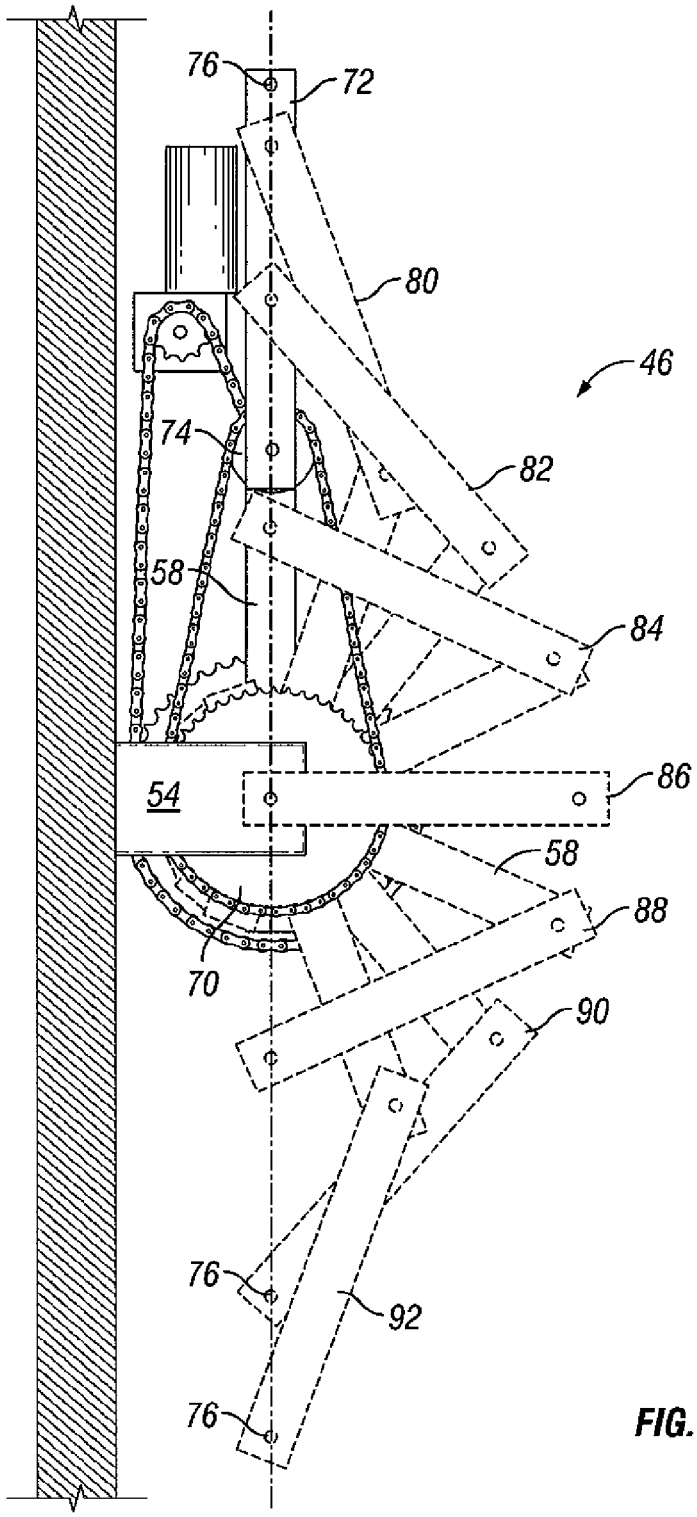
FIG. 6 is a side view of a lifting mechanism of an embodiment of the present invention illustrating eight positions of the lifting mechanism.

FIG. 6 depicts the path of travel of the lifting shaft 76 as primary arm 58 rotates clockwise from vertical in 22.5-degree increments. In this embodiment, the primary arm 58 and secondary arm 72 are of equal effective length. The effective length of each arm is defined as the distance between pivot points on the arms. For example, the effective length of primary arm 58 is the distance between the center point of primary shaft 56 and the center point of secondary shaft 68. The effective length of the secondary arm 72 is the distance between the center point of secondary shaft 68 and the center point of lifting shaft 76.

As primary arm 58 rotates clockwise, secondary arm 72 will rotate counterclockwise an amount equal to double the primary arm rotation relative to the primary arm 58. This doubling of the degrees of rotation is caused by third sprocket wheel 70 having a diameter double the diameter, and therefore double the number of sprockets or cogs, as fourth sprocket wheel 74. Third sprocket wheel 70 is fixed to frame 54 of the lift mechanism, that is it does not rotate relative to the frame 54, Fourth sprocket wheel 74 is solidly attached to secondary arm 72 and rotates about the second shaft 68 connected to primary arm 58.

As depicted in FIG. 6 at position 80, as primary arm 58 rotates 22.5 degrees clockwise, secondary arm 72 will rotate 45 degrees counterclockwise in relationship to primary arm 58. In position 82, the primary arm 58 has rotated 45 degrees clockwise from vertical, and the secondary arm 72 has rotated 90 degrees counterclockwise in relationship to primary arm 58. In position 84, the primary arm 58 has rotated 67.5 degrees clockwise from vertical, and the secondary arm 72 has rotated 135 degrees counterclockwise in relationship to primary arm 58. In position 86, the primary arm 58 has rotated 90 degrees clockwise from vertical, and the secondary arm 72 has rotated 180 degrees counterclockwise in relationship to primary arm 58 and both arms are horizontal. In position 88, the primary arm 58 has rotated 112.5 degrees clockwise from vertical, and the secondary arm 72 has rotated 225 degrees counterclockwise in relationship to primary arm 58. In position 90, the primary arm 58 has rotated 135 degrees clockwise from vertical, and the secondary arm 72 has rotated 270 degrees counterclockwise in relationship to primary arm 58. In position 92, the primary arm 58 has rotated 157.5 degrees clockwise from vertical, and the secondary arm 72 has rotated 315 degrees counterclockwise in relationship to primary arm 58. When the primary arm 58 rotates 180 degrees to its lowermost vertical position, the secondary arm 72 will have rotated 360 degrees in relationship to primary arm 58. As shown in FIG. 6, if the primary and secondary arms are of equal length, the secondary arm lifting shaft 76 travels in a straight line.

FIG. 6 also depicts how the lifting shaft 76, and thus the carriages 2, 6 will continuously accelerate through the first 90 degrees of primary arm 58 rotation and continuously decelerate during the second 90 degrees of primary arm 58 rotation. In this embodiment, the effective length of the primary and secondary arms 58, 72 are both 27 inches for a combined length of 54 inches and results in a total lift distance of double that or 108 inches or 9 feet. This would be the required lift distance for a building with 8 foot lower level ceiling height plus one foot for the upper level floor thickness. That is, the distance between first floor level 4 and second floor level 8 would be nine feet.

In FIG. 6, during the first 22.5 degrees of primary arm rotation in a system with eight-foot lower level ceiling height, the connecting point 76 and thus carriages 2, 6 will move vertically approximately 3.9". During the second 22.5 degrees of primary arm rotation or at 45 degrees, the connecting point 76 will move approximately 11.8". During the next 22.5 degrees of primary arm rotation, the connecting point 76 will travel approximately 17.1". During the last 22.5 degree segment of the first 90 degrees of primary arm rotation, the connecting point will travel 21.2". During this initial 90 degrees of primary arm rotation, the connecting point, and thus the carriages, will travel 54" or one half their total travel. Thus, the connecting point continuously accelerates as the primary arm 58 rotates through the first 90 degrees, since the distance traveled during each segment increases over the previous segment. As the primary arm 58 rotates through its second 90 degrees, the connecting point continuously decelerates to come to a smooth jolt free stop.

In this embodiment, the motor 44 is a substantially constant speed motor and therefore rotates the arm 58 at a substantially constant angular velocity. The speed may change somewhat in response to changing loads. The arms 58 and 72 convert the substantially constant angular velocity of the motor 44 and shaft 58 to variable speed vertical motion of the carriages 2, 6. The motor 44 experiences very little loading at start up since the carriages 2, 6 move only a short distance during the first few degrees of rotation of the lever arm 58. The low starting load may in crease the lifetime of the motor 44 and the various mechanical components of the lifting system 46. The low starting load also allows the motor to accelerate quickly to its substantially constant speed at start up.

In alternative embodiments, the motor 44 could be driven at a variable speed. For example, the motor 44 may be driven with a variable frequency drive, VFD, that changes motor speed by changing frequency. A VFD device may be used in place of the motor starters, for example down motor starter 96 shown in FIG. 7, at little or no increase in cost. A VFD would allow the motor to be started and stopped smoothly by ramping the frequency up and down at the start and stop points, while allowing the motor to be operated at higher speed throughout the majority of the elevator travel. The net result is expected to be reduced overall time of travel without noticeable jolts at the start and stop.

In one embodiment, the drive motor may have three operating regions, a start up or speed up region, a primary drive region and a stop or slow down region. In the start up region, the motor speed may increase from zero to a preselected maximum speed, by ramping up the frequency of the VFD from zero to a frequency that provides the preselected maximum speed. During the primary drive region, the motor speed may be maintained substantially constant at the preselected maximum speed by maintaining the frequency of the VFD at the frequency that provides the preselected maximum speed. In the stop region, the motor speed may decrease from the preselected maximum speed to zero by ramping down the frequency of the VFD from the frequency that provides the preselected maximum speed to zero. The start up and stop regions may comprise a small part of total drive range of the motor, for example about ten percent of the total drive range. The primary drive region may therefore comprise about ninety percent of the total drive range. The lever arms 58, 72 will still provide the acceleration and deceleration functions during all three regions of motor operation and will provide high speed elevator travel in the middle of the primary range.

The lift mechanism of this embodiment provides an advantage in terms of the time required to move a person from one floor to another. Since it accelerates continuously from the start to the midpoint of travel and then decelerates from the midpoint to the end of travel, much higher speed can be attained without the user experiencing a sudden jolt at the start and stop points. In one embodiment, the nine feet of travel can occur smooth and jolt free in less than five seconds. In this embodiment, the carriages pass through the midpoint of travel at a maximum speed of 174 feet per minute, whereas many conventional residential elevators travel at a maximum speed of about twenty to about forty feet per minute. The maximum speed may be increased by use of a VFD as discussed above.

Figure 7:
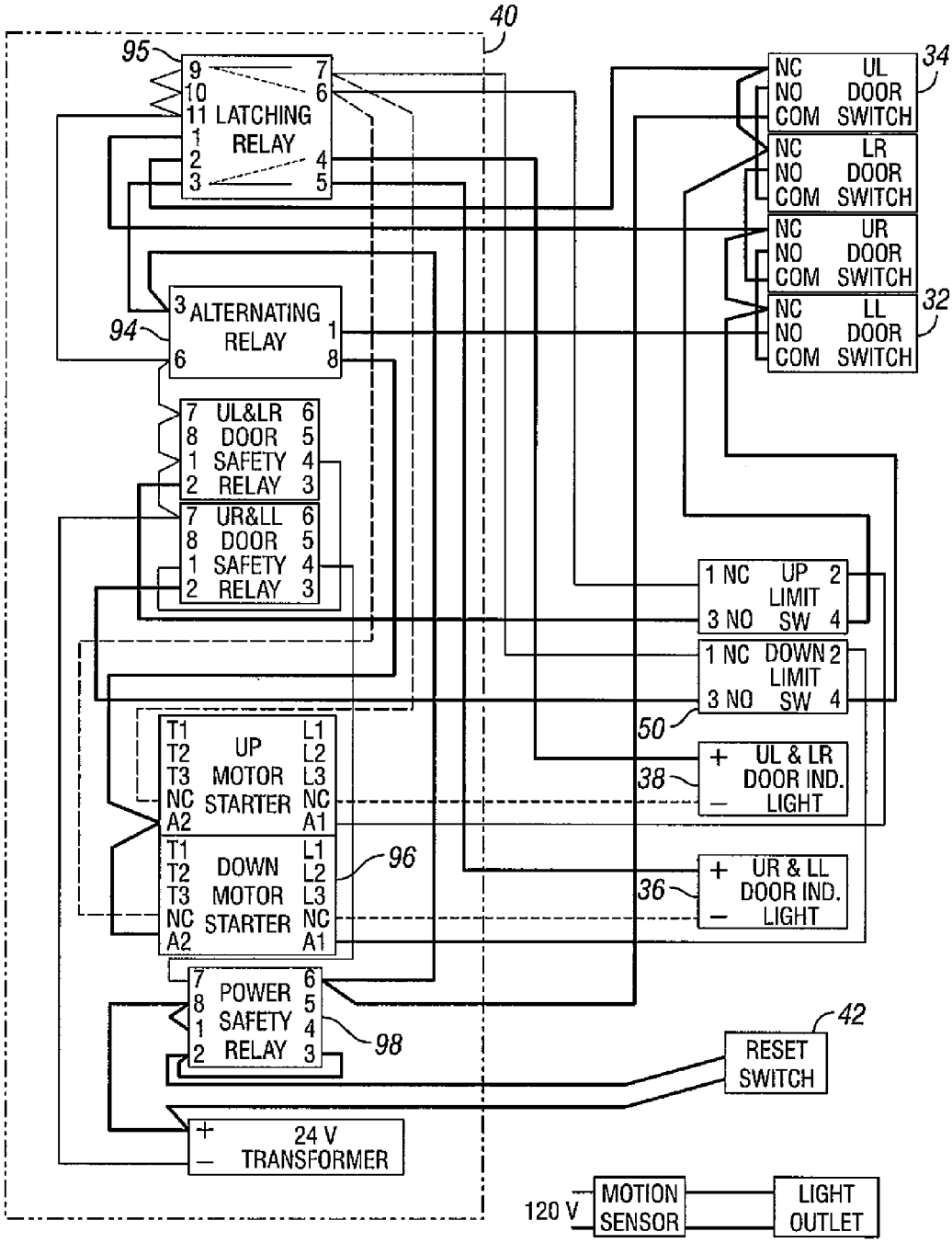
FIG. 7 is an electrical schematic diagram of a control system for an embodiment of the invention.

FIG. 7 is a schematic of an electrical system for controlling operation of the embodiment illustrated in the other figures. Parts that correspond to parts shown on the other figures are identified by the same reference numbers. The dashed line box 40 contains electrical components that are located in the control panel 40 of FIG. 1.

The basic operation of this embodiment will be described with reference to FIGS. 1, 2 and 7 and assuming that a person on the first floor level 4 desires to move to the second floor level 8. With carriage 2 located at the first floor level 4, the indicator light 36 will be turned on and the user wilt know that carriage 2 is behind door 28, ready for use. The user will pull door 28 open and enter the carriage 2. Opening of the door 28 causes door switch 32, the lower left door switch, to change position, which in turn toggles alternating relay 94 which sets the down motor starter relay 96 in a ready position. When the door 28 closes, the door switch 32 changes position again and the down motor starter relay 96 activates motor 44 to drive the lift system 46 and move the carriage 6 down to the first floor level 4 and connecting cables move carriage 2 up to the second floor 8. When the primary arm 58 contacts the down limit switch 50, the motor 44 stops. The user is then on the second level 8 and simply pushes the door 30 open and exits the carriage 2. Upon opening the door 30, the upper level door switch 34 causes the alternating relay 94 to change position, to an inactive position in which the motor starter cannot activate and thus motor 44 will not operate. Opening door 30 and activating switch 34 also switches latching relay 95 to ready the control system for the reverse or up travel of the lift system 46 and also turns on the indicator light 38 indicating that the carriage 2 is now behind door 30 and ready for use. Likewise, the carriage 6 is then on the first floor 4 and an indicator light above its door on the first floor turns on indicating that carriage 6 is ready for use.

At all times when the elevator is not being used, i.e. not occupied and moving, the two carriages 2, 6 will be ready, one on each floor. The user merely opens the door on his level that has an indicator light on, enters the carriage and closes the door. The user is then transported automatically to the other level and may exit by simply pushing the door open.

As discussed above, the door switches, including switches 32, 34, provide the signals to the control system indicating that a user has entered a carriage and is to be transported. The door switches also provide several safety functions and activate two relays that control the lighting system. If any of the doors are opened while the motor 44 is operating, the power safety relay 98 is deactivated and disconnects power from the entire control system including motor 44, bringing the system to a stop. A person in a carriage 2, 6 may exit by pushing either door open and crawling or climbing out. To restart the system, all four doors must be closed and the reset switch 42 must be manually actuated. Thus, the system cannot be started while someone is exiting a carriage through one of the doors. The switch 42 is preferably placed high and out of reach of children.

If the system is not operating, i.e. not moving carriages 2, 6 between floors, and someone opens one of the two doors that do not have a light on, the power safety relay 98 is also deactivated and disconnects power from the control system. If this happens, the user should check behind all doors to be sure no one has entered the spaces where no carriage is located before actuating the reset switch.

The embodiments of the present invention may provide a number of advantages. As noted above, the movement of the carriages has no sudden starts and stops, i.e. no sudden accelerations. Instead, it is constantly accelerated during the first half of the travel distance and decelerates during the second half of travel. This also allows an overall high speed of travel that provides a very short time to move between floors. Despite the high speed, the user does not experience any jolts or jerks typical of many elevators.

Since in the preferred embodiment, the design is only applicable between 2 levels, no controls or other electrical elements are needed in the carriages 2, 6. This avoids the complexity and cost of providing power and signal lines that can move with the carriages 2, 6 as they move between floors.

No braking systems are needed. When the lifting system 46 stops at either the bottom or top, the lift system 46 has a tremendous mechanical advantage that prevents any downward movement of either carriage 2 or 6. In a preferred embodiment, the up limit switch 48 and down limit switch 50 are positioned to allow the primary arm 58 to move slightly past top or bottom dead center. Mechanical stops are provided to prevent any further movement. Any force tending to move the carriages 2, 6 would drive the arm 58 against the mechanical stop and thus further eliminate the need for a mechanical brake to hold the carriages at their respective positions.

The overall distance or length of travel is determined by the effective length of the primary arm 58 plus the effective length of secondary arm 72. It is equal to two times the sum of the effective lengths of the arms. The combined length of the arms can therefore be selected to accommodate any ceiling height, e.g. the eight to twelve foot ceilings available in many residences. However, once the dimensions of the residence are known, it is straightforward to select the lengths of the arms to provide precisely the right distance of travel for the residence. By proper positioning of the lift mechanism 46, the carriages 2, 6 will be aligned with both floors.

It is not required that the two arms 58 and 72 be exactly the same effective length. When they are the same length, the shaft 76 moves in a vertical substantially straight line as shown in FIG. 6. If the arms are of different lengths, the shaft 76 will move in a curved path, with the amount of curve depending on the relative lengths. As a limiting case, if arm 72 and associated sprocket wheels are eliminated and secondary shaft 68 replaces or becomes lifting shaft 76, the path would be a complete half circle. In general, this case is not practical since arm 58 would need to be 54 inches long or longer and would not fit in a space corresponding to the depth of the carriages 2, 6. However, in some embodiments the link 78 connecting shaft 76 to carriage 6 is pivotally connected to carriage 6. That is, a lower end of the link 78 is carried on another shaft connected to the carriage 6. This type of link 78 is preferred to compensate for any misalignment of parts upon installation. If the arms 58, 72 are not of exactly equal length, or are intentionally made of unequal length, then the link 78 will pivot to compensate for any curved movement of the shaft 76. The link 78 is also easily replaceable, or may have multiple pivot holes to allow adjustment of the position of the carriage if the lifting mechanism 46 is not installed at precisely the correct vertical position. By using a pivoted: link 78 that accommodates limited curved movement of the shaft 76, the length of the secondary arm 72 can be adjusted to compensate for non-standard dimensions of the building.

If only one lever arm is used, its effective length would need to be 54 inches for a building with an eight foot first floor ceiling. It would have to be even longer for higher first floor ceilings. Normally this length is greater than the depth of the hoist way 9 and the lift system 46 would not fit on the side of the hoist way 9. In this case, the lift system may be placed behind the carriages 2, 6, since the hoist way 9 has a width sufficient to accommodate both carriages 2 and 6. The link 78 would be attached to the back of carriage 6. As an alternative to the link 78, a horizontal cross rail may be attached to the back of carriage 2 or 6. The lifting shaft 76 may be coupled to the cross rail, e.g. with roller bearings, to accommodate the horizontal motion of the lifting shaft as it travels through a half circle path. The articulated lever arm lift system 46 of FIGS. 4, 5, and 6 is preferred primarily because it can be located at the side of a carriage 6 and provides a lifting shaft that moves substantially in a straight line. Also, in higher lift situations, more than two arms may be used to minimize lift depth.

Regardless of whether the lever arm is a single lever arm or an articulated lever arm, the lifting system 46 comprises a mechanical system that is capable of converting constant velocity rotational motion to vertical lifting motion with variable velocity that starts and stops with essentially zero velocity and accelerates and decelerates between the starting and stopping points to provide an overall high speed movement without any noticeable starting or stopping jolts or jerks. The lever arm system 46 may also work with a variable speed motor as discussed above to provide even higher speed movement over most of the travel distance while having a soft start and stop.

While the present invention has been illustrated and described with respect to certain embodiments, it is apparent that various modifications can be made thereto and various other parts could be substituted for those shown herein without departing from the scope of the invention as defined by the appended claims.

I claim:

1. An elevator for transporting a person vertically between a two floors of a building, comprising:

a hoist way, a first carriage vertically moveable in the hoist way from a first vertical position to a second vertical position, a lifting mechanism coupled to the first carriage, the lifting mechanism comprising;

a primary lever arm having a first end pivotally supported on a first shaft and having a second shaft carried on a second end, a secondary lever arm having a first end pivotally supported on the second shaft and having a second end coupled to the carriage, a first sprocket wheel fixed relative to the building and concentric with the first shaft and having a first diameter, a second sprocket wheel carried on the second shaft, fixed to the secondary lever arm, a first chain belt coupled to both the first sprocket wheel and the second sprocket wheel, and a motive force generator rotating the primary lever arm about the first shaft between a first angular position and a second angular position.

2. An elevator according to claim 1, wherein:

the first sprocket wheel has a first diameter, and the second sprocket wheel has a second diameter being half the first diameter.

3. An elevator according to claim 1, wherein the motive force generator comprises:

an electric motor having an output shaft, a third sprocket wheel carried on the output shaft, a fourth sprocket wheel carried on the first shaft and fixed to the primary lever arm, and a second chain belt coupled to both the third sprocket wheel and the fourth sprocket wheel.

4. An elevator according to claim 3, further comprising:

a gear box reducer coupling the electric motor to the third sprocket wheel.

5. An elevator according to claim 1, wherein the primary lever arm and secondary lever arm are of equal length.

6. An elevator according to claim 1, wherein the primary lever arm and secondary lever arm are of different lengths.

7. An elevator according to claim 1, wherein the secondary lever arm is coupled to the first carriage by a link.

8. An elevator according to claim 7, Wherein the link is pivotally connected to the first carriage.

9. An elevator according to claim 1, wherein the lengths of the primary lever arm and of the secondary lever arm are selected so that the sum of the length of the primary lever arm plus the length of the secondary lever arm is one half the vertical distance between the first vertical position and the second vertical position.

10. An elevator according to claim 1, further comprising:

a counterweight, a pulley, and a cable having a first end coupled to the counterweight, passing over the pulley, and having a second end coupled to the first carriage.

11. An elevator according to claim 1, further comprising:

a second carriage vertically moveable in the hoist way from the first vertical position to the second vertical position, a pulley, and a cable having a first end coupled to the second carriage, passing over the pulley, and having a second end coupled to the first carriage.

12. An elevator according to claim 11, wherein the first vertical position is a lower floor of a building and the second vertical position is an upper floor of a building, further comprising;

first and second safety platforms carried in the hoist way above the first and second carriages respectively, and sized to be movable only above the second vertical position.

13. An elevator according to claim 1, wherein the first vertical position is a lower floor of a building and the second vertical position is an upper floor of the building, further comprising:

an upper door covering the hoist way on the upper floor, and having an upper detector providing a signal when the upper door is opened, a lower door covering the hoist way on the lower floor, and having a lower detector providing a signal when the lower door is opened, and a control system coupled to the upper detector, to the lower detector, and to the lifting mechanism and detecting that a door in front of the carriage has been opened and closed, activating the lift mechanism to move the carriage.

14. An elevator according to claim 13, further comprising the control system detecting that a door in front of the carriage has been opened and closed and placing the lift mechanism in a standby state.

15. An elevator according to claim 14, further comprising the control system detecting that a door in front of the carriage has been opened and closed and activating the lift mechanism to move the carriage.

16. An elevator according to claim 13, wherein the hoist way includes metal guide rails guiding the carriage, further comprising magnets coupled to the upper door and to the lower door and urging the upper door and lower door to closed positions.

* * * * *

UNITED STATES PATENT AND TRADEMARK OFFICE

CERTIFICATE OF CORRECTION

PATENT NO. : 7,296,660 B1
APPLICATION NO. : 11/383790
DATED : November 20, 2007
INVENTOR(S) : Harry G. Bauge It is certified that error appears in the above-identified patent and that said Letters Patent is hereby corrected as shown below:

Col. 6, line 11, replace “frame 54,” with -- frame 54. --

Col. 8, line 11, replace “wilt” with -- will --

Col. 9, line 60, replace “pivoted:” with -- pivoted --

Signed and Sealed this

Fifteenth Day of April, 2008

JON W. DUDAS
*Director of the United States Patent and Trademark Office*